US005836088A

United States Patent [19]

Barney et al.

[11] Patent Number: 5,836,088

[45] Date of Patent: Nov. 17, 1998

[54] MACHINE CONTROLLING ELECTRICAL CIRCUITRY FOR A CLOTHES DRYER

[76] Inventors: Charles A. Barney, P.O. Box 114, Stow, Mass. 01775; James M. Carroll, Jr., 6 Hunting St., Wellesley, Mass. 02181

[21] Appl. No.: 864,763

[22] Filed: May 28, 1997

[51] Int. Cl.[6] ..... F26B 13/10

[52] U.S. Cl. ..... 34/534; 34/572; 34/606

[58] Field of Search ..... 34/534, 558, 570, 34/572, 601, 602, 606; 318/799, 431, 433; 219/400, 492, 518; 340/310.08, 310.06, 538; 200/330, 332

[56] References Cited

U.S. PATENT DOCUMENTS

| | | | |
|---|---|---|---|
| 2,876,556 | 3/1959 | Rulseh | 34/534 X |
| 3,662,475 | 5/1972 | Beller et al. | 34/532 |
| 3,689,718 | 9/1972 | Gorsuch | 34/534 X |
| 4,434,340 | 2/1984 | Kondo | 200/332 |
| 5,493,084 | 2/1996 | Whitaker et al. | 200/330 X |

*Primary Examiner*—Henry A. Bennett
*Assistant Examiner*—Steve Gravini

[57] ABSTRACT

A device controlling electrical circuitry of a clothes drier has a base which snaps into a panel of the drier and supports electrical control elements mounted in a cavity and an operating lid which covers the cavity and effects operating changes in these elements with rearward protruding elements as it is moved along a linear path.

3 Claims, 4 Drawing Sheets

MACHINE CONTROLLING ELECTRICAL CIRCUITRY FOR A CLOTHES DRYER

BRIEF SUMMARY OF THE INVENTION

The invention relates to devices whereby an operator can control electrical circuitry and more particularly to such installed in clothes driers.

The invention features a base which snaps into a panel of an appliance and supports electrical control elements and an operating lid which covers the control elements effects operating changes in these elements by being moved along a linear path.

DETAILED DESCRIPTION

Figure 1:
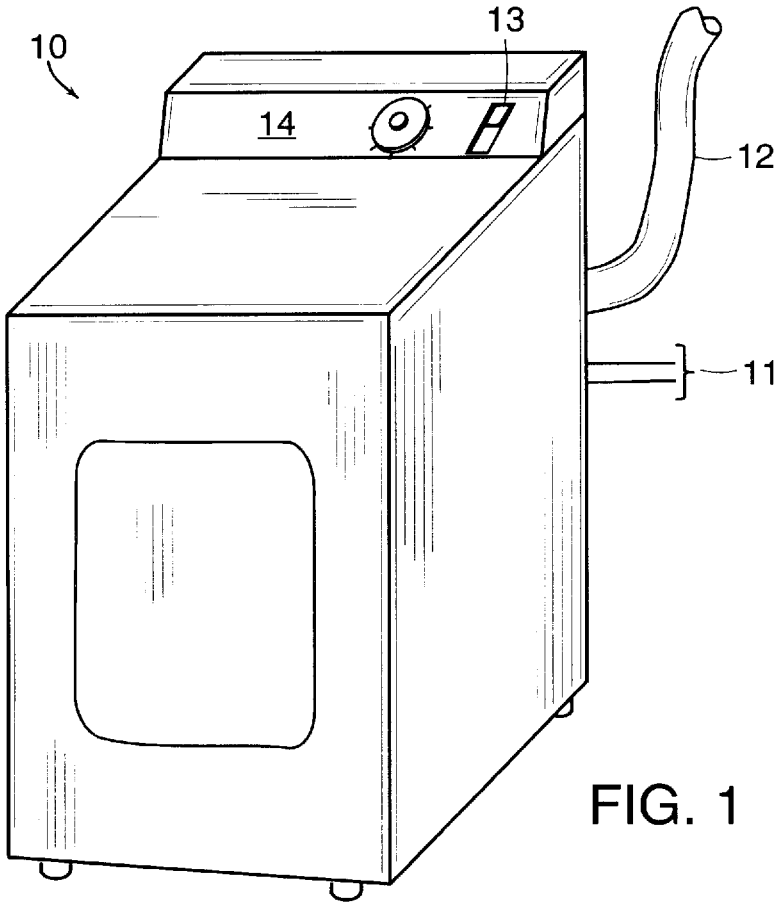
FIG. 1 shows a control device according to the invention installed in clothes drying appliance, electrical circuitry thereof being controlled by the device.

As shown particularly in FIG. 1, electric clothes dryer appliance 10 is conventionally connected by power cable 11 and exhaust line 12. Device 13 according to the invention for controlling electrical circuitry, more specifically the appliance heater, is mounted on generally planar control panel 14 of appliance 10 in a position where it can be manipulated by an operator.

Figure 2:
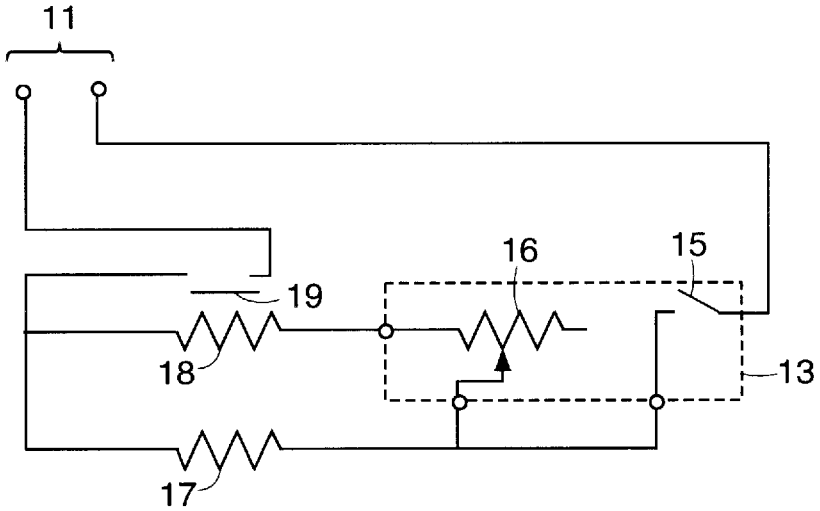
FIG. 2 shows schematically the electrical circuitry of the appliance of FIG. 1 with the device according to the invention connected to control it.

With reference particularly to FIG. 2, device 13 includes electrical components, more specifically switch 15 and variable resistor 16 which are connected to control heating element 17 of appliance 10. The operation of the control is as follows. Thermostat element 18 controls thermostat switch 19 and is heated both by heating derived from heater element 17 and by internal current flowing through variable resistor 16. By changing the value of variable resistor 16 the current through thermostat element 18 changed, inversely changing the heating required from heater 17 to trip thermostat switch 19. Switch 15 turns the heating circuit on and off.

Figure 3:
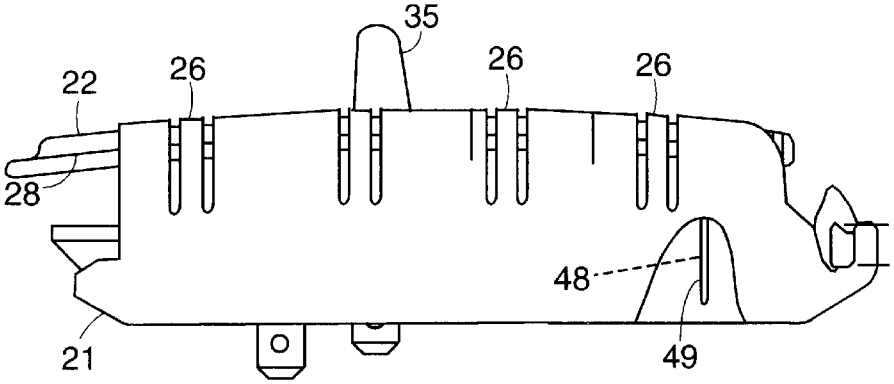
FIG. 3 shows the control device of FIG. 1 in greater detail.
Figure 4:
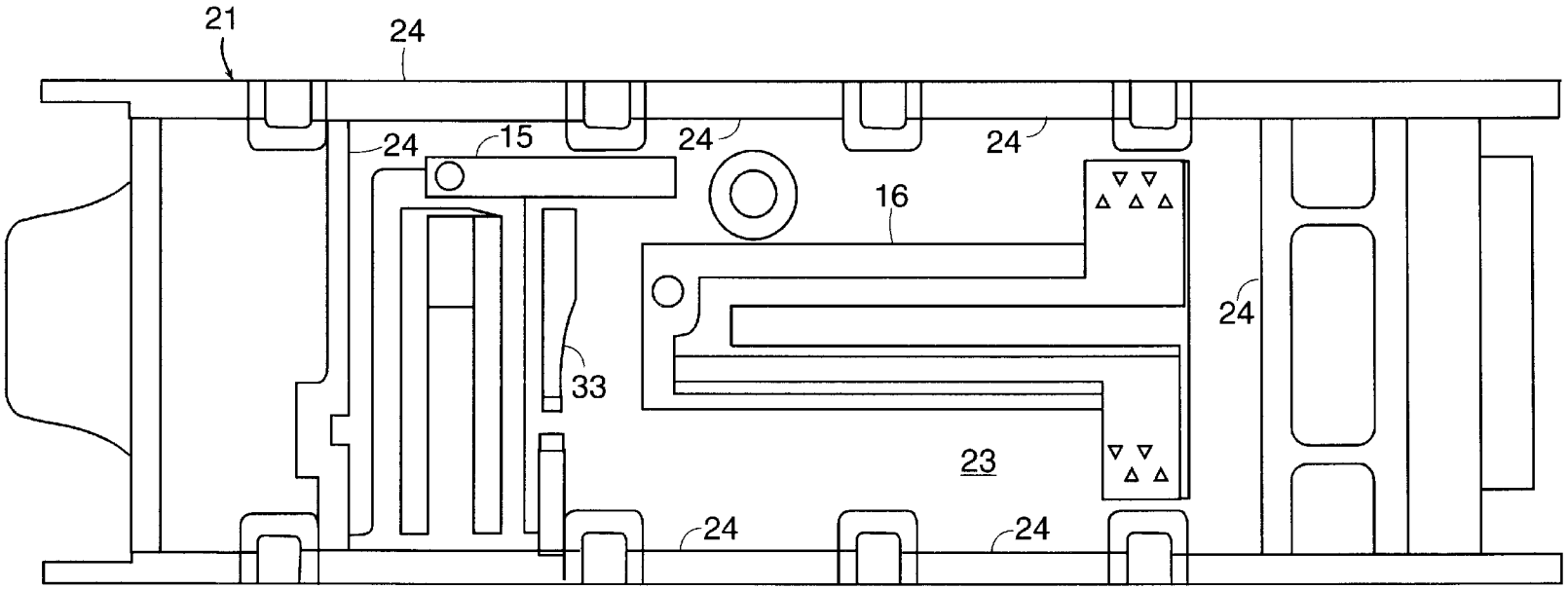
FIG. 4 shows the base of the device of FIG. 1 with the operating lid removed in a view looking from the front of the appliance.
Figure 5:
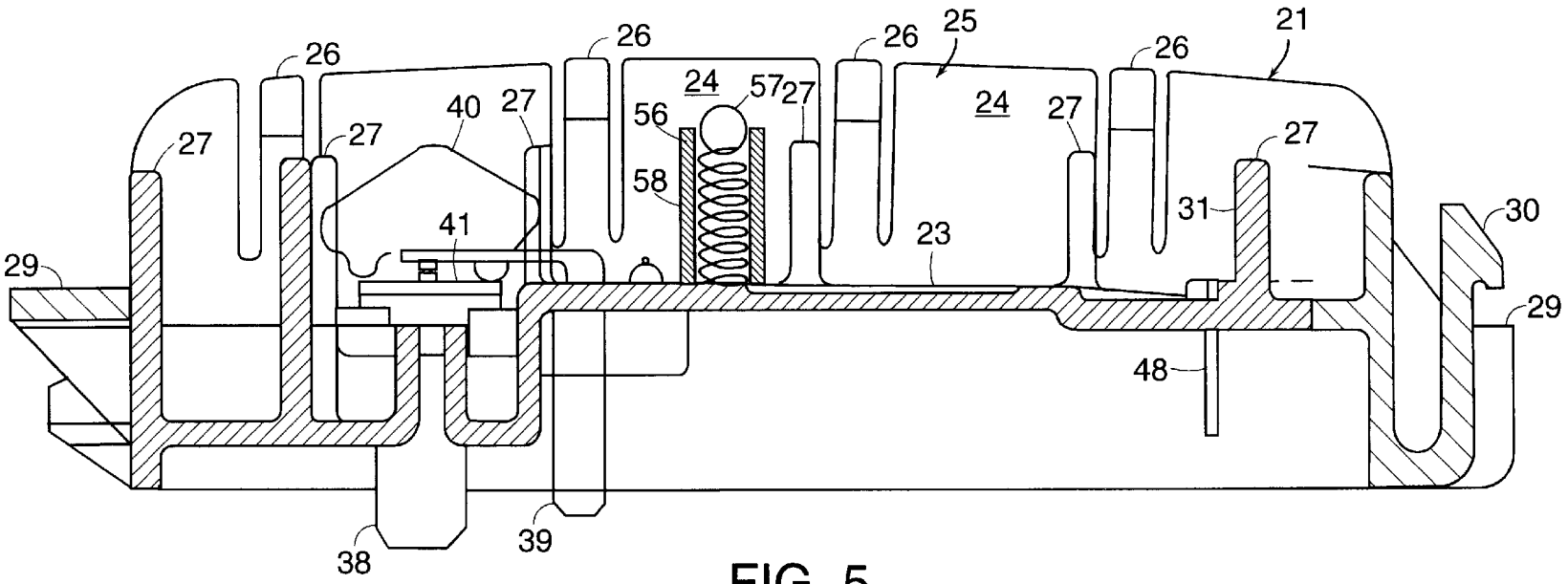
FIG. 5 shows a cross-sectional view of the base shown in FIG. 4.

Device 13 includes base 21 which has tab 29 and snaps 30 which provide attaching structure for attaching base 21 to panel 14 Base 21 includes floor 23 parallel to the front surface of panel 14 and walls 24 defining a cavity 25 open on one side only. Snap hooks 26 and posts 27 capture operating lid 22 and provide constraining structure which engage with mating rails 28 of operating lid 22 to constrain operating lid 22 to move (with respect to the base) with one degree of freedom approximately parallel to the front of panel 14. Wall 31 of base 21 functions as range limiting structure by impacting interfering structure 32 of operating lid 22 when operating lid moves to the right (as shown in FIG. 3) so as to limit the range of motion of the lid to the right. Wall 33 of base 21 similarly impacts interfering structure 34 of operating lid 22 so as to limit the range of motion of lid 22 to the left. Handle structure 35 of operating lid 22 is shaped to receive forces from an operator to move lid 22 through a range between position where interfering structure 32 impacts range limiting structure 31 and the position where interfering structure 34 impacts range limiting structure 33. So captured and constrained, operating lid has a forward face 36 presented to an operator of appliance 10 and a rearward face 37 facing into cavity 25. The dimensions of operating lid 22 and cavity 25 are arranged so that cavity 25 is covered by lid 22 in all positions within the range of motion of lid 22.

Switch 15 is mounted on floor 23 of base 21 and is connected to terminals 38 and 39. Actuator wafer 40 rests on movable switch element 41.

Figure 6:
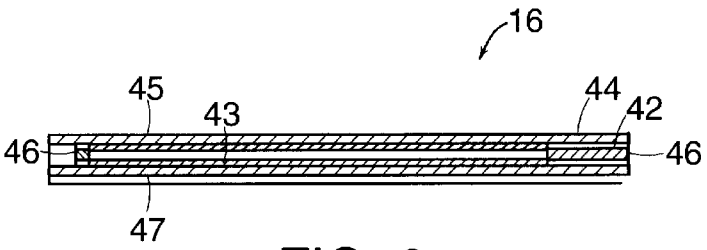
FIG. 6 shows a detail of the variable resistor mounted in the base shown in FIGS. 4 and 5.
Figure 7:
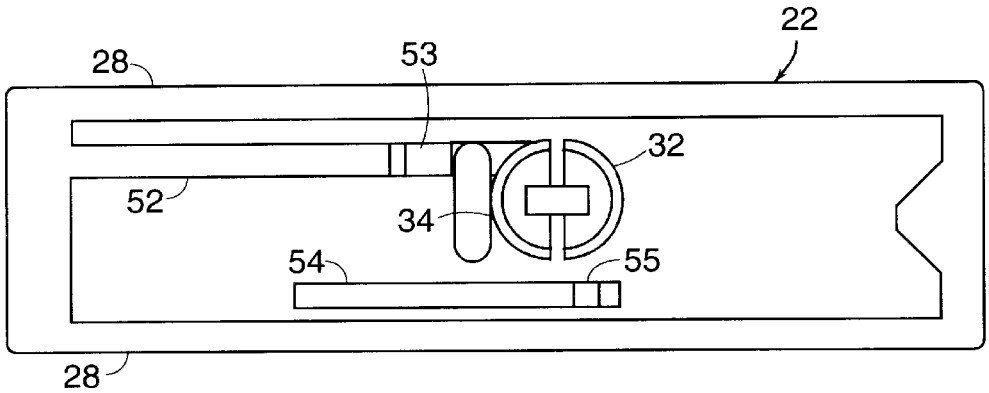
FIG. 7 shows the operating lid of the device of FIG. 1 in a view looking from the back of the appliance.
Figure 8:
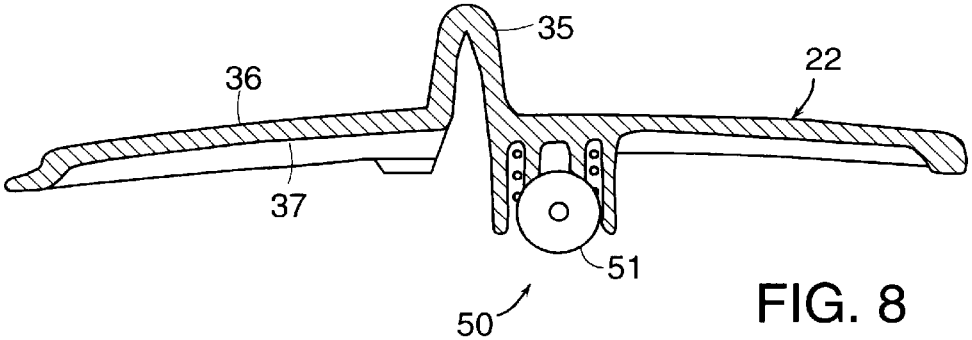
FIG. 8 shows a cross-sectional view of the operating lid shown in FIG. 7.
Figure 9:
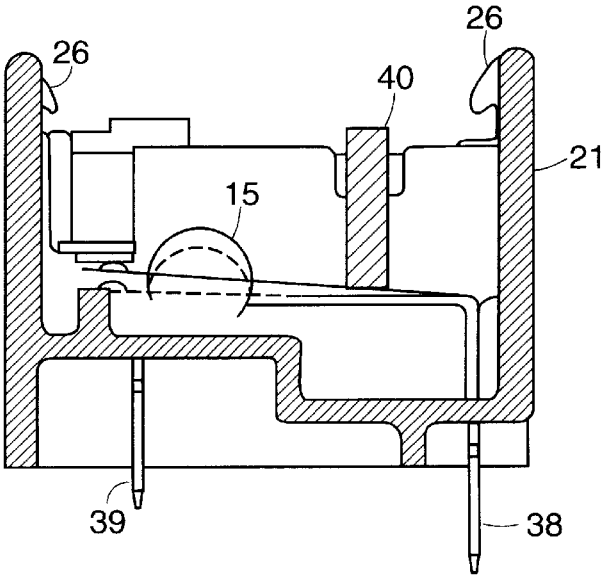
FIG. 9 shows a detail of a switch affixed to the base shown in FIG. 4

Variable resistor 16 is affixed to floor 23. Resistor 16 has a membrane sandwich construction as shown particularly in FIG. 6. Underneath membrane 42 has a strip 43 of resistive ink printed on it. Top membrane 44 has a strip 45 of conductive ink printed on it. The two membranes are assembled on support membrane 47 with the printed surfaces facing one another and spaced apart by spacers 46. The one end of the resistive ink strip is connected to terminal 48, and conductive ink strip is connected to terminal 49. Absent any pressures on the membrane sandwich the resistive ink strip and the conductive ink strip are not in electrical contact. When however the sandwich is squeezed at some point along the opposed strips, the inks are put in contact to connect terminals 48 and 49. The resistance between terminals 48 and 49 depends on the position along the strips where they are squeezed into contact.

Protrusion 50 extends rearwardly from rearward face 37 of operating lid 22 into cavity 25 and supports spring loaded roller 51, which acts as a pressure foot pressing against variable resistor 16 and squeezing the inks together at a point depending on the position of lid 22. Ramp 52 runs parallel to the permitted motion of lid 22 and extends rearward from rearward face 37 of operating lid 22 into cavity 25. Ramp 52 extends from lid 22 by different amounts along its length, the greatest extension being at area 53. Ramp 52 is in contact with actuator wafer 40 and when lid 22 is moved to its left limit position presses against actuator wafer to open switch 15.

Ramp 54 runs parallel to the permitted motion of lid 22 and extends rearward from rearward face 37 of operating lid 22 into cavity 25 and includes a notch 55 therein. Detent turret 56 affixed to and extending forward from floor 23 of base 21 holds contact ball 57 biased forward by spring 58 against ramp 54. When operating lid 22 to a position where notch 55 opposes contact ball 57, ball 57 is pushed into notch 55 to stabilize the motion of lid 22 and provide a detent.

The operation of the circuitry control device is as follows. The base 21 is snapped into control panel 14 using tabs 21 and snaps 30, and terminals 39, 39, 48, and 49 are connected. An operator of the appliance then controls the set point of the heater by using handle 35 to move operating lid to different positions along its permitted direction of motion or turns the heater completely off by moving the operating lid to the detented position at one end of its range position where switch 15 is opened.

A circuitry control device according to the invention and as described above is advantageous in requiring a small number of inexpensive parts. The operating lid serves both as a cover and an actuating member, and both the base and the lid can inexpensively made from polymeric material by extrusion molding.

We claim:

1. A machine controlling electrical circuitry comprising a base and an operating lid, both made of polymeric material by injection molding, said base comprising a floor and walls defining a cavity open on one side only attaching structure for attaching to an instrument panel, constraining structure capturing and constraining said operating lid, said operating lid comprising two edge runners which engage with said constraining structure so that said operating lid is constrained to linear motion in one degree of freedom only, said base including range limiting structure and said operating lid including interfering structure protruding into said cavity, said range limiting structure and said interfering structure impacting at two positions of the operating lid to limit motion of said operating lid to a range of positions, said operating lid enclosing said cavity by covering said one open side thereof in all positions in said range of positions, an electrical switch being affixed to said floor of said base, said switch being oriented so that it is thrown by an actuating force acting in a direction perpendicular to said floor, a variable resistor of the type having opposed printed membranes being affixed to said floor in an orientation to be actuated by an actuating force acting in a direction perpendicular to said floor, said operating lid including a pressure foot extending into said cavity and pressing against said variable resistor, a ramp running parallel to the linear motion of the operating lid, said ramp extending into said cavity by different amounts along its length, said ramp when said operating lid is moved to one end of said range pressing against and throwing said electrical switch.

2. A machine controll1ng electrical circuitry as claimed in claim 1, including a second ramp extending into said cavity, said second ramp having a notch therein, said machine also including a spring loaded structure supported on said base which bears on said second ramp and enters said notch when said operating lid in moved to a particular position in said range, thereby providing a detent stabilizing said operating lid in said particular position.

3. For mounting on a control panel having a generally planar front surface, a machine controlling electrical circuitry comprising a base and an operating lid, said base including attaching structure for attaching to a generally planar control panel said base including lid constraining structure and said lid including contrary mating structure, said lid constraining structure and said constraint mating structure engaging to constrain motion of the lid relative to the base to motion with one degree of freedom approximately parallel to a generally planar front surface of a control panel to which the machine is attached by said attaching structure, said base including range limiting structure and said operating lid including interfering structure, said range limiting structure and said interfering structure impacting at two positions of the operating lid to limit motion of said operating lid to a range of positions, said machine further comprising an electrical component which assumes different states depending on an actuating mechanical force applied thereto, said electrical component being affixed to said base in an orientation such that the direction of said actuating mechanical force is perpendicular to a generally planar front surface of a panel to which the machine is attached by said attaching structure, said operating lid having a protrusion extending rearward which engages with said electrical component and applies an actuating force thereto, such force varying with position of said operating lid within said range of motion, said operating lid including a handle structure shaped to receive forces to move said lid through said range from a hand of an operator.

* * * * *